United States Patent [19]

Kobayashi et al.

[11] 4,428,120

[45] Jan. 31, 1984

[54] HOLDER FOR SUPPORTING A ROTARY CUTTING BLADE

[75] Inventors: Kiyoaki Kobayashi; Taiichi Kumasaka, both of Katsuta, Japan

[73] Assignee: Hitachi Koki Company, Tokyo, Japan

[21] Appl. No.: 357,223

[22] Filed: Mar. 11, 1982

[30] Foreign Application Priority Data

Apr. 24, 1981 [JP] Japan ..... 56-60107

[51] Int. Cl.[3] ..... B27G 19/04

[52] U.S. Cl. ..... 30/390; 83/666; 83/698

[58] Field of Search ..... 83/666, 698; 30/388–391; 51/168

[56] References Cited

U.S. PATENT DOCUMENTS

| | | | |
|---|---|---|---|
| 2,854,042 | 9/1958 | Robinson | 83/666 |
| 3,266,535 | 8/1966 | Brodie | 30/390 |
| 3,371,691 | 3/1968 | Ehinger | 30/390 |
| 3,456,696 | 7/1969 | Gregory et al. | 30/391 |

*Primary Examiner*—James M. Meister

*Attorney, Agent, or Firm*—Pollock, Vande Sande & Priddy

[57] ABSTRACT

A holder for supporting a rotary cutting blade such as a saw blade for an electric circular saw comprises a drive shaft rotatable on its own axis and having a larger-diameter portion and a smaller-diameter portion concentric therewith, a fixed flange fitted over the larger-diameter portion and having an annular support extending around and spaced radially from the smaller-diameter portion for mounting thereon the rotary cutting blade, and a removable flange having an annular projection inserted between the annular support and the smaller-diameter portion and secured by a screw axially to the smaller-diameter portion with the rotary cutting blade sandwiched between the fixed and removable flanges. The annular support and the smaller-diameter portion have distal ends lying axially flush with each other. The fixed flange and the larger-diameter portion are corotatably secured to each other by interengaging flat faces thereof, and likewise the removable flange and the smaller-diameter portion are corotatably fixed to each other by flat faces thereof held in interengagement.

13 Claims, 8 Drawing Figures

HOLDER FOR SUPPORTING A ROTARY CUTTING BLADE

BACKGROUND OF THE INVENTION

The present invention relates to a holder for supporting a rotary circular cutting blade such as a saw blade for an electric circular saw.

Prior art circular saws include a fixed flange fitted over drive shaft and havng an annular support on which a saw blade is mounted, and a removable flange fixed by a screw axially to the drive shaft with the saw blade sandwiched in position between the fixed and removable flanges. The drive shaft has a distal end projecting axially beyond the annular support. To remove the saw blade, the screw is unfastened to detach the removable flange, then the saw blade is axially displaced along the drive shaft away from the fixed flange until the saw blade clears the projecting end of the drive shaft, and finally the saw blade is pulled away across the drive shaft. For attachment of the saw blade, it also needs to be axially carried along the projecting drive shaft before reaching the fixed flange. The circular saws have a protective cover assembly including movable and fixed cover members which are deep enough to accommodate such axial displacement of the saw blade when the latter is to be removed or attached. The protective cover assembly is therefore large in size, making the circular saws relatively heavy. The circular saws also include a base to be held against a workpiece, the base having an opening in which the saw blade is rotatable and which is wide enough to allow the saw blade to be axially moved during attachment or detachment thereof. The wide opening in the base renders handling of the circular saw awkward especially when cutting off narrow workpieces.

SUMMARY OF THE INVENTION

It is an object of the present invention to provide a rotary cutting blade holder which is relatively small in size and light-weight.

According to the present invention, a holder for supporting a circular cutting blade such as a saw blade comprises a drive shaft having a larger-diameter portion and a smaller-diameter portion, a first flange fitted over the larger-diameter portion and having an annular support for mounting the circular cutting blade thereon, and a second flange having an annular projection insertable between the annular support and the smaller-diameter portion when the second flange is secured by a screw axially to the smaller-diameter portion. The annular support and the smaller-diameter portion having distal ends lying axially flush with each other. The first flange and the larger-diameter portion are corotatably secured to each other by at least one flat face on the larger-diameter portion which is held in engagement flatwise with at least one flat face in a central bore in the first flange. Likewise, the second flange and the smaller-diameter are corotatably engageable with each other by at least one flat face on the smaller-diameter portion which can be held flatwise against a flat face in a central bore in the second flange.

The above and other objects, features and advantages of the present invention will become more apparent from the following description when taken in conjunction with the accompanying drawings in which certain preferred embodiments are shown by way of illustrative example.

DETAILED DESCRIPTION

Figure 1:
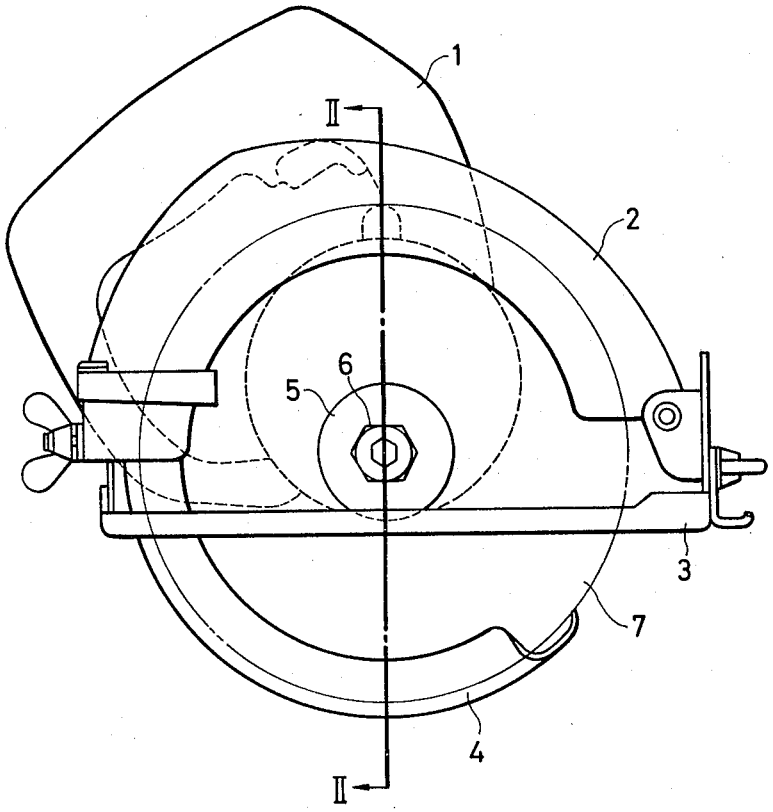
FIG. 1 is a side elevational veiw of an electric circular saw.
Figure 2:
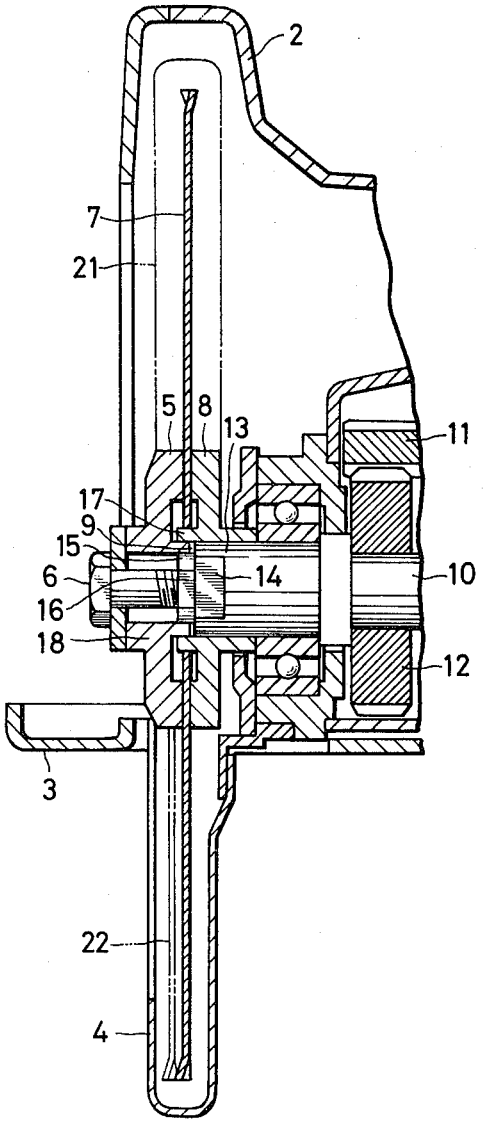
FIG. 2 is a fragmentary vertical cross-sectional view taken along line II—II of FIG. 1.

As shown in FIGS. 1 and 2, an electric circular saw comprises a body 1, a protective cover member 2 fixed to the body 1, a base 3 mounted on the body 1 for being held flatwise against a workpiece such as a lumber to be cut off by the electric circular saw, and a protective cover member 4 angularly movably mounted on the body 1, the fixed and movable protective cover members 2, 4 extending peripherally around and over the saw-toothed circumferential edge of a saw blade 7.

Figure 4:
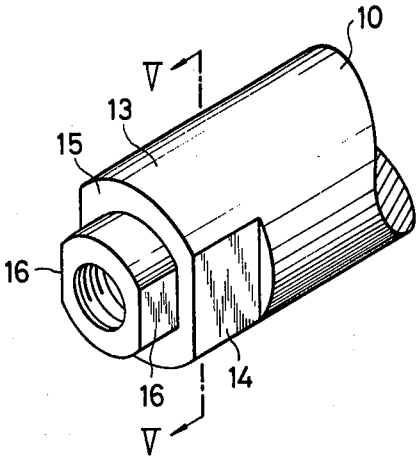
FIG. 4 is an enlarged fragmentary perspective view of a drive shaft.
Figure 5:
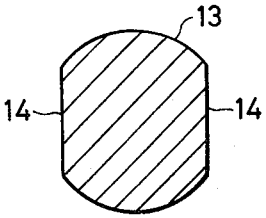
FIG. 5 is a cross-sectional view taken along line V—V of FIG. 4.

As best illustrated in FIG. 2, the saw blade 7 is sandwiched in position between removable and fixed flanges 5, 8 interfitting with each other. The fixed flange 8 is fitted over a drive shaft 10 rotatable by an electric motor (not shown) through gears 11, 12. The drive shaft 10 includes a larger-diameter portion 13 disposed in a central bore 8*a* (FIG. 3) in the fixed flange 8 and having a pair of diametrically opposite flat faces 14, 14 (FIG. 5), and a smaller-diameter portion 15 concentric with the larger-diameter portion 13 and separated therefrom by a step or shoulder 9 and having a pair of diametrically opposite flat faces 16, 16 (FIG. 4). The fixed flange 8 has an annular support 17 fitted in a central hole in the saw blade 7, and extending around and spaced radially outwardly from the smaller-diameter portion 15. The annular support 17 and the smaller-diameter portion 15 have distal ends lying flush or substantially flush with each other, as shown in FIG. 2.

The removable flange 5 includes an annular projection 18 inserted between the annular support 17 and the smaller-diameter portion 15 with the saw blade 7 interposed between the removable and fixed flanges 5, 8. The removable flange 5 is secured axially to the smaller-diameter portion 15 by a screw 6 threaded thereinto.

Figure 3:
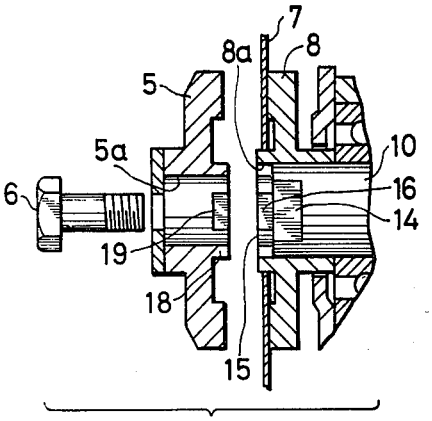
FIG. 3 is a fragmentary exploded cross-sectional view of a saw blade holder.
Figure 6:
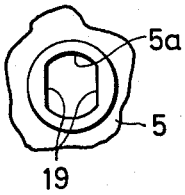
FIG. 6 is a fragmentary front elevational view of a removal flange.
Figure 7:
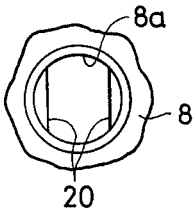
FIG. 7 is a fragmentary front elevational view of a fixed flange.

In FIGS. 3 and 6, the removable flange 5 has a central bore 5*a* and a pair of diametrically opposite flat faces 19, 19 therein which are engageable flatwise with the diametrically opposite flat faces 16, 16, respectively, on the smaller-diameter portion 15, so that the removable flange 5 and the smaller-diameter portion 15, when assembled together, are corotatably secured to each other. The fixed flange 8 also has a central bore 8*a* (FIG. 7) and a pair of diametrically opposite flat faces 20, 20 therein which are held in engagement flatwise with the diametrically opposite flat faces 14, 14, respectively, on the larger-diameter portion 13. Thus, the fixed flange 8 is corotatably fixed to the larger-diameter portion 13.

For detachment of the saw blade 7, the movable protective cover member 4 is turned upwardly to an upper position illustrated by the phantom line 21 in FIG. 2, and then the screw 6 is removed to unfasten removable flange 5 out of interfitting engagement with the fixed flange 8. The saw blade 7 is now axially displaced to the position indicated at 22 where it clears the distal ends of the annular support 17 and the smaller-diameter portion 15, whereupon the saw blade 7 can be pulled away downwardly through an opening the base 3. The saw blade 7 can be attached in a reversed procedure.

With the arrangement of the invention, the saw blade 7 can easily be removed by being axially displaced through a relatively small distance since the distal end of the drive shaft 10 is aligned with that of the annular support 17. In addition, the removable flange 5 can securely be assembled with the fixed flange 8 through their interfitting engagement with each other. Therefore, the fixed and movable protective cover members 2, 4 may be of a relatively small depth to accommodate axial displacement of the saw blade 7 during attachment or detachment thereof. The electric circular saw may thus be smaller in size and weight. The opening in the base 3 may also be reduced in width, so that narrow workpieces can be sawed safely and speedily with ease.

Figure 8:
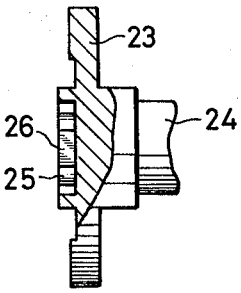
FIG. 8 is a fragmentary side elevational view, partly in cross section, of a drive shaft having an integral flange.

According to a modification shown in FIG. 8, a fixed flange 23 is formed integral with a drive shaft 24, which includes a smaller-diameter portion 25 having a pair of diametrically opposite flat faces 26 engageagble flatwise with the corresponding flat faces on the removable flange 5.

The present invention is applicable to not only electric circular saws, but also various other tools having rotatable circular cutting blades.

Although certain preferred embodiments have been shown and described in detail, it should be understood that many changes and modifications may be made therein without departing from the scope of the appended claims.

What is claimed is:

1. A holder for supporting a rotary cutting blade having a central hole, comprising:

a drive shaft rotatable about its own axis and having a larger-diameter portion and a smaller-diameter portion which are concentric with each other;

a first flange fitted over said larger-diameter portion and having an annular support extending around and spaced radially from said smaller-diameter portion, said annular support and said smaller-diameter portion having distal ends lying axially flush with each other;

first means for corotatably fixing said first flange to said larger-diameter portion;

a second flange having an annular projection insertable between said annular support and said smaller-diameter portion for sandwiching the rotary cutting blade between said first and second flanges with said annular support fitted in the central hole in the rotary cutting blade;

second means for corotatably fixing said second flange to said smaller-diameter portion; and a fastener for securing said second flange axially to said smaller-diameter portion.

2. A holder according to claim 1, said first flange having a central bore receiving therein said drive shaft, said first means comprising at least on first flat face in said central bore and at least one second flat face on said larger-diameter portion and held in engagement flatwise with said first flat face.

3. A holder according to claim 2, said first means comprising a pair of first diametrically opposite flat faces in said central bore and a pair of second diametrically opposite flat faces on said larger-diameter portion and held in engagement flatwise with said first diametrically opposite flat faces, respectively.

4. A holder according to claim 1, said second flange having a central bore, said second means comprising at least one first flat face in said central bore and at least one second flat face on said smaller-diameter portion and engageable flatwise with said first flat face.

5. A holder according to claim 4, said second means comprising a pair of first diametrically opposite flat faces in said central bore and a pair of second diametrically opposite flat faces on said smaller-diameter portion and engageable flatwise with said first diametrically opposite flat faces, respectively.

6. A holder for supporting a rotary cutting blade having a central hole, comprising:

a drive shaft rotatable about its own axis and having an integral first flange and a smaller-diameter portion concentric therewith, said first flange having an annular support extending around and spaced radially from said smaller-diameter portion, said annular support and said smaller-diameter portion having distal ends lying axially flush with each other;

a second flange having an annular projection insertable between said annular support and said smaller-diameter portion for sandwiching the rotary cutting blade between said first and second flanges with said annular support fitted in the central hole in the rotary cutting blade;

means for corotatably fixing said second flange to said smaller-diameter portion; and a fastener for securing said second flange axially to said smaller-diameter portion.

7. A holder according to claim 6, wherein said second flange is provided with a central bore, said means comprising at least one first flat face in said central bore and at least one second flat face on said smaller-diameter portion and engageable flatwise with said first flat face.

8. A holder according to claim 7, wherein said means comprises a pair of first diametrically opposite flat faces in said central bore and a pair of second diametrically opposite flat faces on said smaller-diameter portion and engageable flatwise with said first diametrically opposite flat faces, respectively.

9. A circular saw comprising:

a body;

a saw blade having a central hole and a saw-toothed circumferential edge;

a first protective cover member fixedly mounted on said body and extending around and over said saw-toothed circumferential edge of the saw blade;

a second protective cover member movably mounted on said body and extending around and over said saw-toothed circumferential edge of the saw blade;

a base mounted on said body and having an opening in which said saw blade is rotatable;

a drive shaft rotatable about its own axis and having a larger-diameter portion and a smaller-diameter portion which are concentric with each other;

a first flange fitted over said larger-diameter portion and having an annular support extending around and spaced radially from said smaller-diameter portion, said annular support and said smaller-diameter portion having distal ends lying axially flush with each other;

first means for corotatably fixing said first flange to said larger-diameter portion;

a second flange having an annular projection insertable between said annular support and said smaller-diameter portion for sandwiching the saw blade between said first and second flanges with said annular support fitted in the central hole in the saw blade;

second means for corotatably fixing said second flange to said smaller-diameter portion; and a fastener for securing said second flange axially to said smaller-diameter portion.

10. A circular saw according to claim 9, wherein said first flange is provided with a central bore receiving therein said drive shaft, said first means comprising at least one first flat face in said central bore and at least one second flat face on said larger-diameter portion and held in engagement flatwise with said first flat face.

11. A circular saw according to claim 10, wherein said first means comprises a pair of first diametrically opposite flat faces in said central bore and a pair of second diametrically opposite flat faceds on said larger-diameter portion and held in engagement flatwise with said first diametrically opposite flat faces, respectively.

12. A circular saw according to claim 9, wherein said second flange is provided with a central bore, said second means comprising at least one first flat face in said central bore and at least one second flat face on said smaller-diameter portion and engageable flatwise with said first flat face.

13. A circular saw according to claim 12, wherein said second means comprises a pair of first diametrically opposite flat faces in said central bore and a pair of second diametrically opposite faces on said smaller-diameter portion and engageable flatwise with said first diametrically opposite flat faces, respectively.

* * * * *